US010190377B2

(12) United States Patent
Wheater et al.

(10) Patent No.: US 10,190,377 B2
(45) **Date of Patent: *Jan. 29, 2019**

(54) MUD SENSING HOLE FINDER

(71) Applicants: Guy Wheater, Scarborough (GB); Stuart Huyton, Elgin (GB)

(72) Inventors: Guy Wheater, Scarborough (GB); Stuart Huyton, Elgin (GB)

( * ) Notice: Subject to any disclaimer, the term of this patent is extended or adjusted under 35 U.S.C. 154(b) by 208 days.

This patent is subject to a terminal disclaimer.

(21) Appl. No.: 15/138,548

(22) Filed: Apr. 26, 2016

(65) Prior Publication Data

US 2016/0237769 A1 Aug. 18, 2016

Related U.S. Application Data

(63) Continuation of application No. 14/025,590, filed on Sep. 12, 2013, now Pat. No. 9,435,169.

(30) Foreign Application Priority Data

Jun. 17, 2013 (GB) ..... 310750.3

(51) Int. Cl.

| | |
|---|---|
| ***E21B 23/14*** | (2006.01) |
| ***E21B 47/01*** | (2012.01) |
| ***E21B 47/06*** | (2012.01) |
| ***E21B 47/10*** | (2012.01) |
| ***E21B 47/12*** | (2012.01) |

(52) U.S. Cl.

CPC ..... *E21B 23/14* (2013.01); *E21B 47/011* (2013.01); *E21B 47/06* (2013.01); *E21B 47/065* (2013.01); *E21B 47/10* (2013.01); *E21B 47/12* (2013.01)

(58) Field of Classification Search

CPC ..... E21B 23/002; E21B 23/14

See application file for complete search history.

(56) References Cited

U.S. PATENT DOCUMENTS

| | | | | | |
|---|---|---|---|---|---|
| 1,618,848 | A * | 2/1927 | Sanford | B60B 37/10 | 295/45 |
| 2,340,648 | A * | 2/1944 | Daniel | B61D 11/00 | 105/364 |
| 3,587,740 | A * | 6/1971 | Gerwick | E21B 17/05 | 166/227 |
| 4,415,030 | A * | 11/1983 | Walkow | E21B 17/1057 | 166/241.5 |
| 5,674,034 | A * | 10/1997 | Bennett | F16B 39/10 | 411/120 |
| 6,179,058 | B1 * | 1/2001 | Wittrisch | E21B 23/14 | 166/384 |
| 2003/0084715 | A1 * | 5/2003 | Zazovsky | E21B 47/06 | 73/152.05 |

(Continued)

OTHER PUBLICATIONS

Non-Final Rejection for U.S. Appl. No. 14/025,590 dated Dec. 8, 2015.

(Continued)

*Primary Examiner* — Brad Harcourt
*Assistant Examiner* — Steven A MacDonald
(74) *Attorney, Agent, or Firm* — Tumey L.L.P.

(57) ABSTRACT

A mud sensing hole finder comprising: a front steering wheel assembly, a rear wheel assembly, a sensor package, a corrosion package, a ported housing, and a tapered spring joint; wherein the mud sensing hole finder is capable of attachment to a wireline logging tool-string.

8 Claims, 16 Drawing Sheets

(56) References Cited

U.S. PATENT DOCUMENTS

| | | | | |
|---|---|---|---|---|
| 2005/0178543 | A1* | 8/2005 | Giacomino | E21B 43/121 166/250.01 |
| 2006/0233627 | A1* | 10/2006 | Weinstein | F16B 39/04 411/369 |
| 2008/0077332 | A1* | 3/2008 | Newman | G01N 3/32 702/34 |
| 2011/0247879 | A1* | 10/2011 | Johnston | E21B 25/00 175/58 |
| 2013/0299188 | A1* | 11/2013 | Ahmed | G01V 11/005 166/381 |
| 2013/0301389 | A1* | 11/2013 | Alford | E21B 47/12 367/81 |

OTHER PUBLICATIONS

Notice of Allowance for U.S. Appl. No. 15/025,590 dated Aug. 8, 2016.

* cited by examiner

MUD SENSING HOLE FINDER

CROSS-REFERENCE TO RELATED APPLICATIONS

This application claims priority to U.S. Ser. No. 14/025,590 filed Sep. 12, 2013 which claims priority to United Kingdom patent application number GB1310750.3 filed Jun. 17, 2013, which are incorporated by reference herein in their entirety.

STATEMENT REGARDING FEDERALLY SPONSORED RESEARCH OR DEVELOPMENT

Not applicable.

BACKGROUND OF THE INVENTION

Field of the Invention

The present invention relates to wireline logging and, more particularly, in one or more embodiments, the present invention relates to a device for improving the conveyance of wireline logging tools down irregular and/or deviated boreholes while also acquiring data about the borehole environment.

Background of the Invention

Wireline logging is a common operation in the oil industry whereby down-hole electrical tools are conveyed on wireline (also known as "e-line" in industry parlance) to evaluate formation lithologies and fluid types in a variety of boreholes. In irregular shaped boreholes, characterized by variations in hole size with depth, and/or in deviated boreholes, there may be problems in conveying wireline logging tools to total well depth, since the bottom of the tool-string may impact upon certain features in the borehole such as ledges, washouts, or contractions. Additionally, high drags, mud properties, or accumulation of solids/debris may also result in early termination of the wireline descent. In this situation, full data acquisition from total well depth may not be possible and remedial action may be required, either altering the borehole conditions for more favorable descent or improving the tool-string configuration to navigate past the obstructions; either solution may be costly to the well operator.

The term "hole finder" is commonly used in the wireline industry for a device that connects below a logging tool-string to improve conveyance performance and to overcome obstacles in the borehole. Conventional hole finders do not contain independent sensing packages that are capable of acquiring data about the borehole environment.

The examination of mud properties at borehole depth intervals may provide important clues as to the root cause of the wireline descent problems. For example, formation fluid influxes may upset the rheology of the mud, resulting in a gelling which may obstruct the passage of the wireline logging tool-string down hole. The settling of drilling mud in deviated sections of the borehole may reduce the local buoyant tool-string weight and also increase the fluid drag force; both of which may negatively impact the tool-string descent down-hole. Conventional conveyance models, also known as wireline tension models, do not consider variable mud properties in their design, and assume that buoyancy and fluid forces remain constant from the borehole surface to total depth. The absence of the consideration of variable fluid properties in the modeling may lead to false assumptions about conveyance performance and consequently lead the wireline operator into serious operational difficulties.

Consequently, there is a need for improving wireline tool-string configuration to aid conveyance past ledges, washouts, and contractions which may be present in irregular shaped and/or deviated boreholes and to sense and understand the borehole environment to best estimate how the mud properties might impact the conveyance of wireline logging tools.

BRIEF SUMMARY OF SOME OF THE PREFERRED EMBODIMENTS

These and other needs in the art are addressed in an embodiment of a mud sensing hole finder. The mud sensing hole finder has a front steering wheel assembly, a rear wheel assembly, a sensor package, a corrosion package, a ported housing, and a tapered spring joint. The mud sensing hole finder is capable of attachment to a wireline logging tool-string.

These and other needs in the art are addressed in another embodiment by a mud sensing hole finder. The mud sensing hole finder has a front steering wheel assembly, a rear wheel assembly, a sensor package, a corrosion package, a ported housing, and a tapered spring joint. The ported housing comprises threaded connections to the front steering wheel and the tapered spring joint, pressure equalization ports, and angled flow ports. The front steering wheel assembly comprises a mandrel that holds a common axle and a set of profiled and grooved wheels. In addition, the rear wheel assembly comprises a mandrel that holds a common axle and a set of profiled and grooved wheels. Moreover, the sensor package comprises a surface acquisition module that performs time-depth conversions of the acquired data. The corrosion package comprises a carrier holding multiple metallic test coupons and a test sample of logging cable. The tapered spring joint comprises two halves, a main pin, and a spring, and wherein the main pin connects the two halves and wherein the spring is under compression. The mud sensing hole finder is capable of attachment to a wireline logging tool-string. In some embodiments, the main pin is fixed rigidly in a lower half of the tapered spring joint.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which:

FIG. 3(*b*) illustrates the mud sensing hole finder on the low side of a deviated borehole;

FIG. 4(*b*) illustrates an embodiment of the mud sensing hole finder after actuation of the spring joint, allowing lateral (upwards) movement of the front steering wheel over a ledge;

FIG. 6(*b*) illustrates an alternative isometric exploded view of an embodiment of the front steering wheel assembly;

FIG. 6(*c*) illustrates an isometric view of an embodiment of the front steering wheel axle;

FIG. 7(*b*) illustrates an isometric view of an embodiment of the front steering wheel during rolling action in a rugose borehole, and the rotation about the spring joint main pin;

FIG. 9(*b*) illustrates an isometric view of an embodiment of the carrier for corrosion coupons and sample logging cable;

FIG. 10(*b*) illustrates an isometric view of an embodiment of the diverted mud flow up through the ported housing when running in hole;

FIG. 10(*c*) illustrates an isometric view of an embodiment of the diverted mud flow down through the ported housing pulling out of hole;

FIG. 11(*b*) illustrates an isometric view of an embodiment of the tapered spring joint;

FIG. 11(*c*) illustrates an isometric view of an embodiment of the blanking plug which is utilized in the upper half of the tapered spring joint;

FIG. 12(*b*) illustrates an alternative exploded isometric view of an embodiment of the rear wheel assembly to show the retaining bolt thread and alignment hole.

DETAILED DESCRIPTION OF THE PREFERRED EMBODIMENTS

Figure 1:
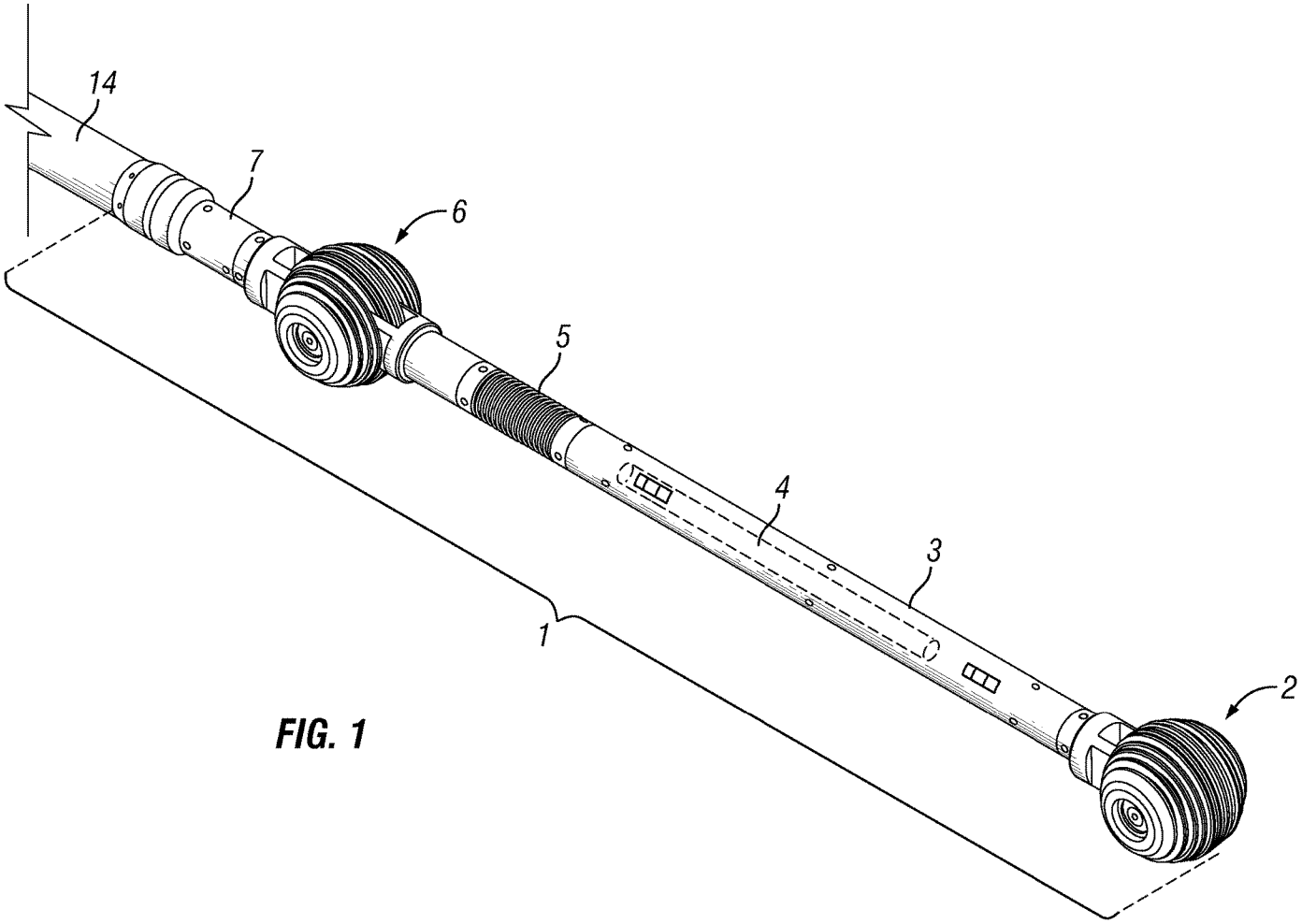
FIG. 1 illustrates an isometric view of an embodiment of a mud sensing hole finder.

In embodiments, the mud sensing hole finder (MSHF) aids the conveyance of wireline logging tool-strings in boreholes while acquiring data about the borehole environment. Specifically, the mud sensing hole finder may perform the following tasks: aiding navigation past hazardous obstructions in the boreholes such as ledges, contractions, washouts, and deviated sections which might otherwise impede or prematurely terminate full descent to the bottom of the borehole; acquiring a broad range of data with an independent logging package for the purpose of borehole diagnostics and wireline conveyance optimization, including down-hole force modeling with fluid effects; and carrying metallic test coupons and a sample of wireline logging cable for the assessment of corrosive elements in the mud. In an embodiment, the sample of wireline logging cable provides corrosion analysis, mechanical testing, archiving, or any combinations thereof.

Generally, in embodiments, the mud sensing hole finder may be run in the borehole. While running in the borehole, the wheels may rotate and cut through the mud cake and debris on the low side of the borehole. During this down-hole movement, the mud is diverted up through the inside of the ported housing passed the sensor and corrosion package. The front steering wheel may roll left or right according to borehole geometry and rugosity; this roll is facilitated by the rotation of the main pin in the spring joint, regardless of whether the spring is compressed or not. If the front steering wheel encounters an obstruction in the borehole, such as a ledge, the spring joint may be activated to allow lateral movement of the steering wheel up over the obstruction. Finally, when the mud sensing hole finder is pulled out of the borehole the direction of the mud flow through the ported housing is reversed and a second opportunity to gain continuous sensor data and corrosion detection is achieved.

In embodiments, the memory logging system may record data as a function of time and a time-depth conversion may be created back on the surface by data processing software; thus borehole and mud properties may be plotted vs. well depth for the purpose of diagnostics and conveyance analysis. As an example, manometer or gradiometer data may be employed to estimate mud weight vs. depth, which may then be used to model the impact of buoyancy forces on the down-hole logging equipment. Other recorded mud data, such as viscosity may also be employed to estimate fluid drag forces imposed on the wireline tool-string.

By recording only borehole pressure and temperature, the mud sensing hole finder may provide data able to analyze borehole pressure, borehole temperature, mud density, and/or loss/influx identification all as a function of borehole depth. However, note that the borehole survey data must be available (or acquired) to convert measured depth to vertical depth.

As a further example, the mud density may be calculated by the formula: dP/dD, where dP=Pv1−Pv2 and dD=Dv1−Dv2 and where Pv1 is the pressure at vertical depth−1, Pv2 is the pressure at vertical depth−2, Dv1 is the pressure at vertical depth−1, and where Dv2 is the pressure at vertical depth−2. As another example, the loss/influx identification plot may be calculated by the formula: dT/dD, where dT=T1−T2 and dD=D1−D2 and where T1 is the pressure at depth−1, where T2 is the pressure at depth−2, where D1 is the pressure at depth−1, and where D2 is the pressure at depth−2.

FIG. 1 illustrates an embodiment of the mud sensing hole finder 1 (MSHF 1) which may comprise a series of modular components connected together via stub acme threads. Towards the bottom or front of the MSHF 1 is a front steering wheel assembly 2 which may comprise three grooved and profiled wheels connected to a common axle. In embodiments, a ported housing 3 may be attached to the front steering wheel assembly 2. The ported housing 3 may reach lengths of up to several meters long depending on the length of the sensor and corrosion package 4 contained inside. The sensor and corrosion package 4 may be disposed within the ported housing 3 and is represented in FIG. 1 by the dashed line section within the ported housing 3. In embodiments, the ported housing 3 may be connected to a tapered spring joint 5. Tapered spring joint 5 may be preloaded by an external spring such that it remains rigid until impacting a borehole obstruction such as a ledge. In embodiments, a rear wheel assembly 6 may be disposed above or behind the tapered spring joint 5. In an embodiment, tapered spring joint 5 is pivotable to facilitate lateral movement of front steering wheel assembly 2 passed obstructions in a borehole. Rear wheel assembly 6 may be responsible for lifting the bottom of the wireline tool-string 14 off of a deviated or otherwise obstructed borehole wall, and rear wheel assembly 6 may also create a low friction rolling environment to aid the tool-string descent. In embodiments, a crossover 7 may be disposed between the rear wheel assembly 6 and the wireline logging tool-string 14. The crossover 7 to the wireline logging tool-string 14 may be customized to the logging vendors' tool connection. In embodiments, sensor and corrosion package 4 includes a sensor package and a corrosion package. In an embodiment, the sensor package acquires data about the borehole and borehole fluids. In some embodiments, the data comprises hydrostatic pressure, temperature, salinity, viscosity, velocity, fluid identification, gas detection, borehole directional data, formation gamma rays, or any combinations thereof. In an embodiment, the corrosion package detects the presence of corrosive elements in a borehole by metallic test coupons. In embodiments, MDHF 1 has a carrier holding multiple metallic test coupons. In an embodiment, the metallic test coupons comprise Ni—Cr—Fe, Cu—Ni alloys, or any combinations thereof. In further embodiments, the test coupons react to $H_2S$. In some embodiments, front steering wheel assembly 2 is rollable about an axis of tapered spring joint 5.

Figure 2:
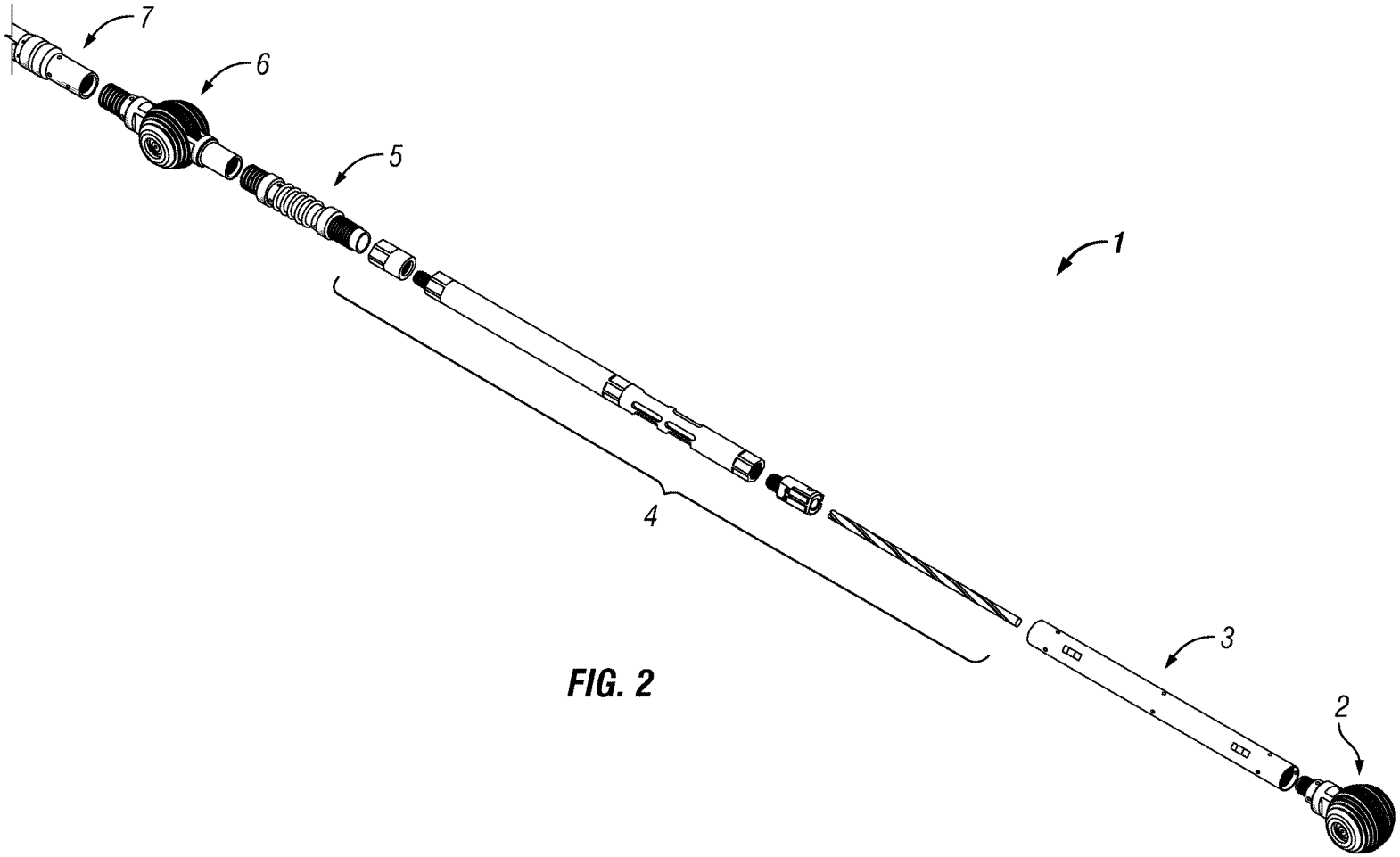
FIG. 2 illustrates an exploded isometric view of an embodiment of the mud sensing hole finder.

FIG. 2 is an exploded view of an embodiment of the mud sensing hole finder 1 that illustrates the sensor and corrosion package 4 which is located inside the ported housing 3. The sensor and corrosion package 4 represents a minimum configuration which may comprise only a memory logging manometer and thermometer; in alternative embodiments, more data intensive configurations may be used. Some of these alternative embodiments may require a longer ported housing which may be up to several meters long.

Figure 3A:
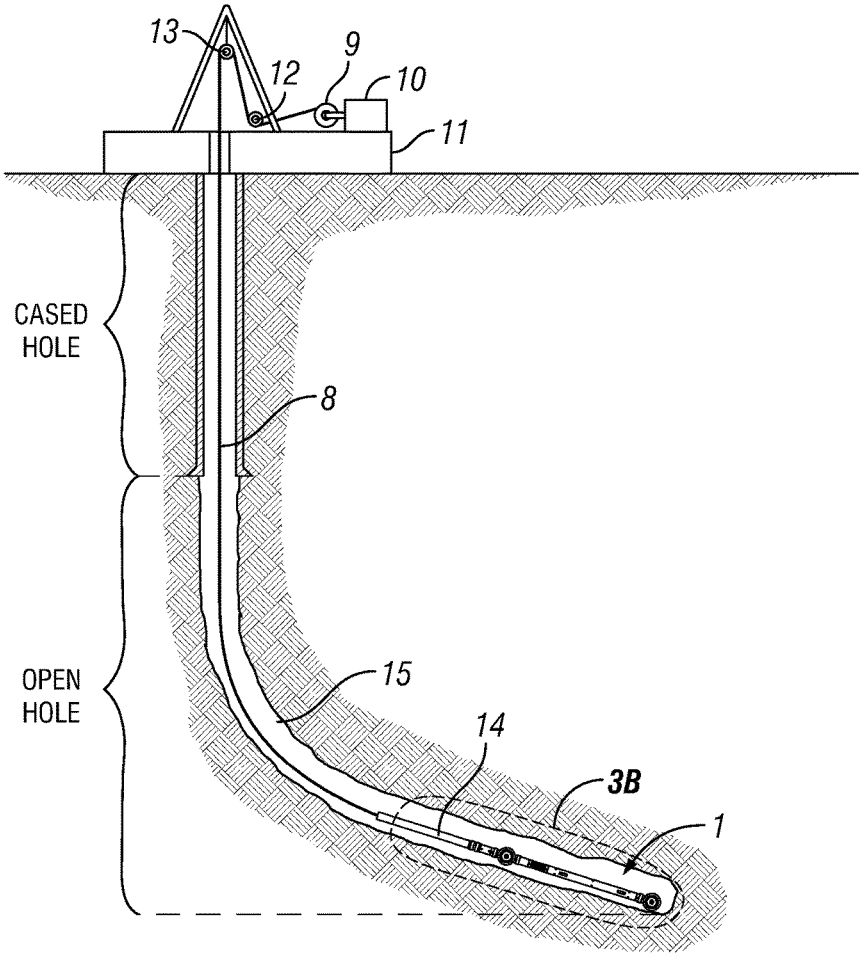
FIG. 3(*a*) illustrates an embodiment for the mud sensing hole finder in relation to the drilling rig, logging tools and borehole.
Figure 3B:
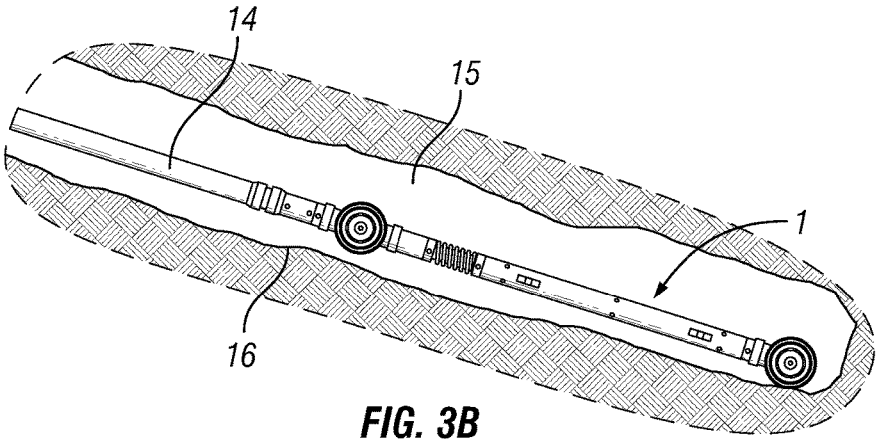

FIG. 3(*a*) illustrates an embodiment of a generic logging operation with the MSHF 1 deployed below the wireline logging tool-string 14 in a borehole 15. The drilling rig, ship, or platform 11 is located above the borehole 15 and comprises a wireline logging unit 10. Wireline logging unit 10 comprises data acquisition equipment and associated devices mounted securely to the drilling structure. Wireline cable 8 may be spooled off the drum 9 around the lower sheave 12 and upper sheave 13 into the borehole 15. At the end of the wireline cable 8, a wireline logging tool-string 14 may be used to acquire petro-physical data or samples from the borehole 15. Below the wireline logging tool-string 14 is the MSHF 1.

FIG. 3(*b*) illustrates an embodiment of the MSHF 1. In this embodiment, the MSHF 1 aids conveyance of the wireline logging tool-string 14 down the borehole 15, by virtue of its wheels, steering capacity, and ability to actuate itself past obstacles such as ledges or deviated sections 16.

Figure 4A:
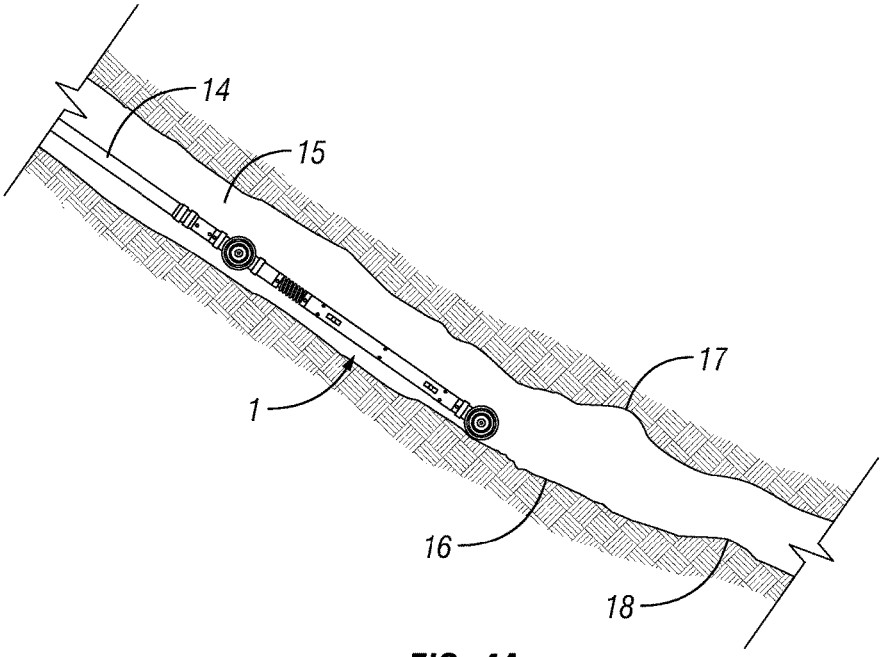
FIG. 4(*a*) illustrates an embodiment of the mud sensing hole finder in relation to hazards that may be found in irregular shaped and/or deviated boreholes, such as ledges and washouts.
Figure 4B:
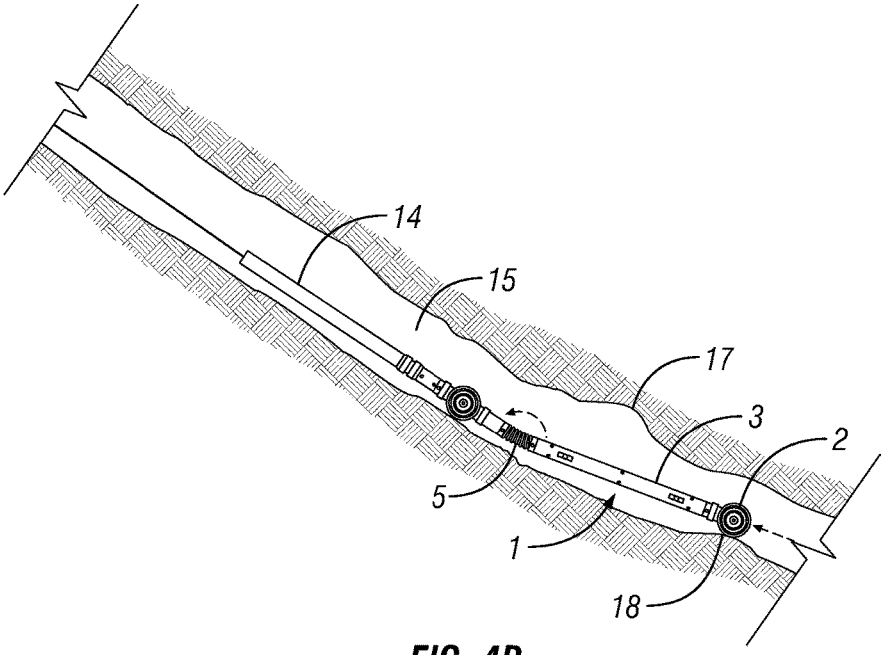

FIG. 4(*a*) illustrates a close up view of an embodiment of the MSHF 1, attached to a wireline logging tool-string 14, as it navigates its way down the open hole section of borehole 15 which lies beneath the cased hole section of borehole 15 as illustrated in FIG. 3(*a*). In embodiments, the wheels of the MSHF 1 may run on the low side of a deviated section 16 of borehole 15 and various hazards in the borehole may be identified such as a washout 17 or a ledge 18.

FIG. 4(*b*) illustrates an embodiment of the MSHF 1 when the front steering wheel assembly 2 impacts a ledge 18 in the borehole 15. The arrow indicates the compressive force applied to the spring joint and the anticlockwise rotation about the spring joint to permit the front steering wheel to rise over the ledge. As the buoyant weight is transferred from the wireline logging tool-string 14 above or behind the MSHF 1, the tapered spring joint 5 compresses and allows articulation of the front steering wheel assembly 2 and ported housing 3 over the ledge to continue descent down the borehole. In this embodiment, once the front steering wheel assembly 2 drops past the ledge 18, its weight, the weight of the ported housing 3, and the tapered spring joint 5 force, thrust the tapered spring joint 5 to its default locked position, stiff and straight, where no articulation is allowed.

Figure 5:
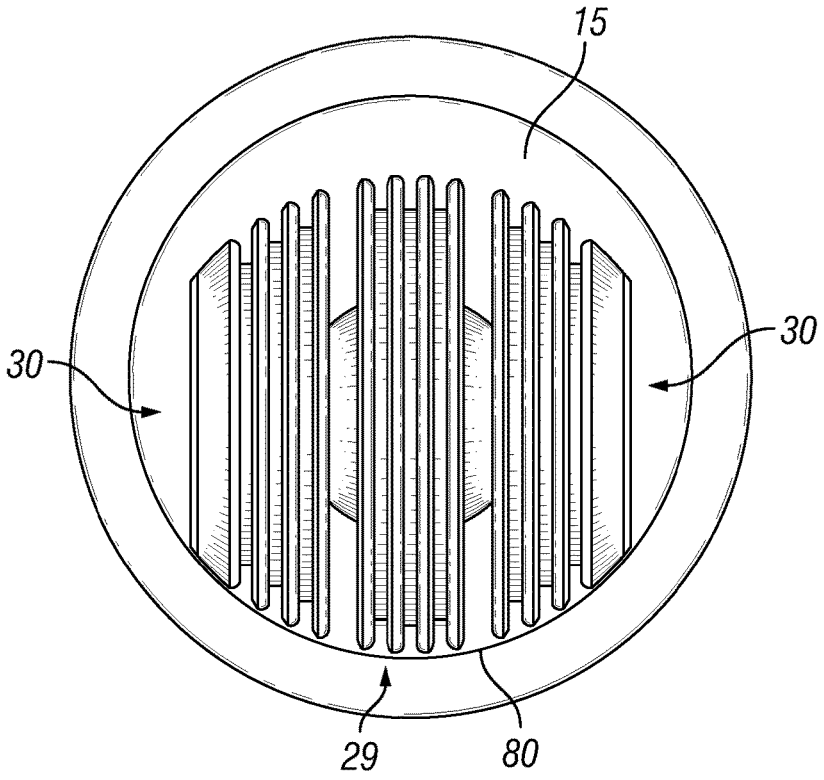
FIG. 5 illustrates an end on view embodiment of the front steering wheel in the borehole.

FIG. 5 shows an end view of an embodiment of the mud sensing hole finder wheels, central wheel 29 and outer wheels 30. This perspective illustrates the position, clearance, and profile of the wheels as would be seen from within, for example, borehole 15. In embodiments, the two outer wheels 30 may be of the same specification, with radial grooves on their outer surfaces to cut through cake and debris which may present on the low side of the borehole wall 80. The grooves in the wheels 29 and 30 may also reduce the contact area and mitigate differential sticking forces against the borehole wall 80. The central wheel 29 may also be grooved for the same purpose. In embodiments, prior to the operation, the central wheels 29 and outer wheels 30 may be installed on the mud sensing hole finder. The wheels may be matched to the diameter of the borehole being logged.

Figure 6A:
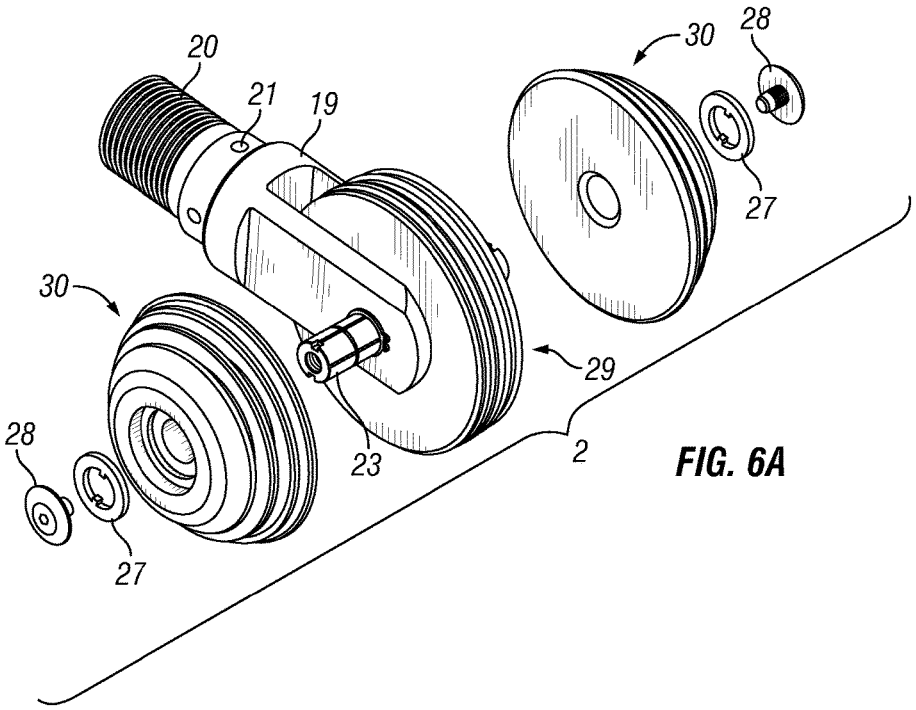
FIG. 6(*a*) illustrates an exploded isometric view of an embodiment of the front steering wheel assembly.
Figure 6B:
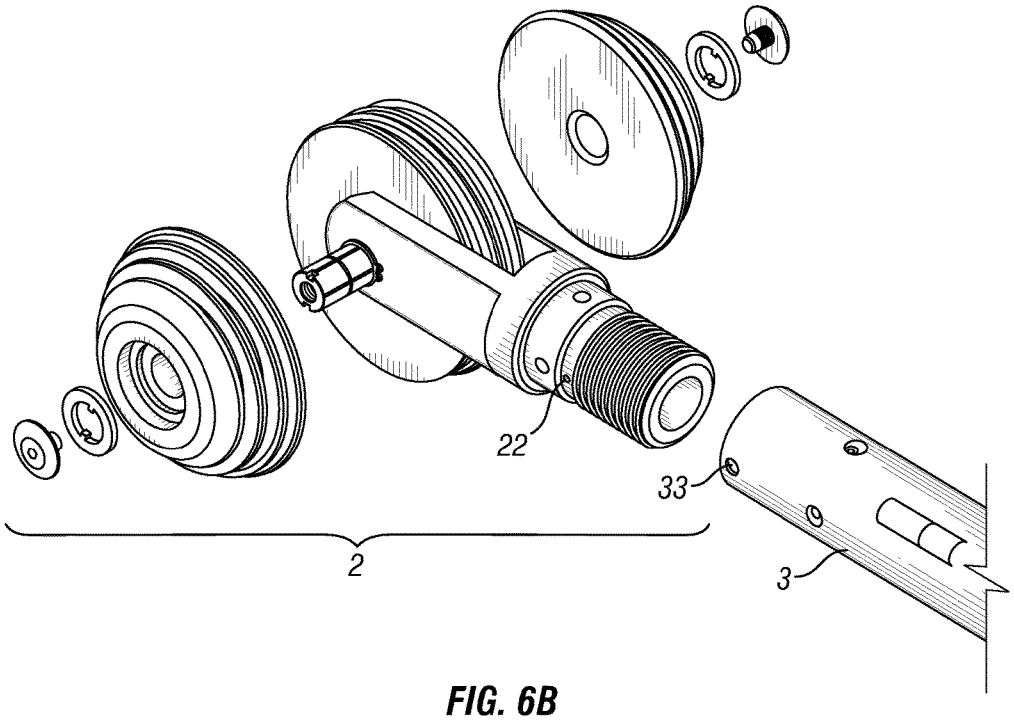
Figure 6C:
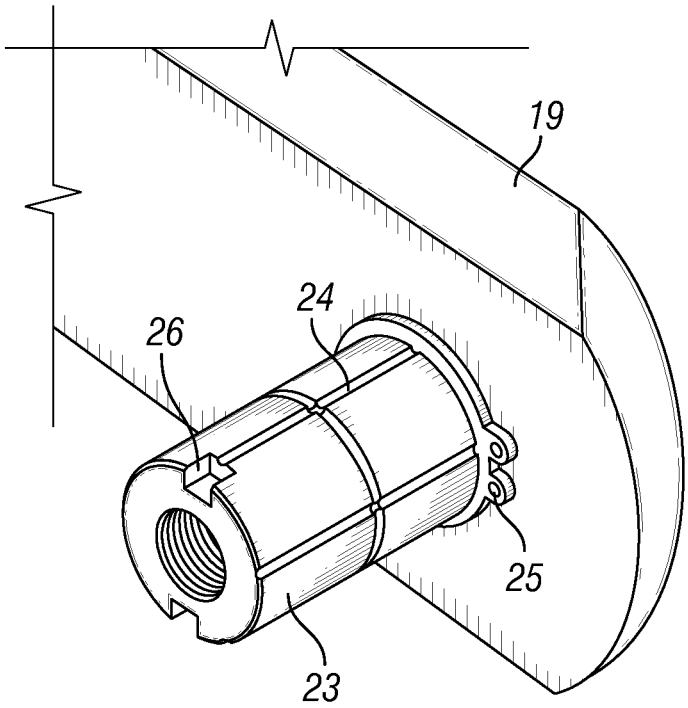

FIG. 6(*a*) shows an exploded isometric view of an embodiment of the front steering wheel assembly 2. The mandrel 19 has a male stub acme thread 20 for connection to the lower end of the ported housing 3 (not shown in FIG. 6(*a*)). A series of radial holes 21 may be drilled into the mandrel 19 body to permit the use of a C-spanner to rotate the mandrel 19 during fitment to the ported housing 3. A common axle 23 is disposed within a deep slot in the mandrel 19. The common axle 23 holds the mounting for the central wheel 29 and the outer wheels 30. The common axle 23 has internal threads on both ends for fitment of axle end bolts 28 and also anti-rotation washers 27 which may isolate rotational forces from the outer wheels 30 and which may otherwise act to undo the axle end bolts 28. In embodiments, the common axle 23 may comprise radial and axial grease ports for wheel lubrication. The common axle 23 is located positively in the mandrel by exterior circlips and an internal keyway (not shown). The circlips may stop sideways slippage of the common axle 23 in the mandrel 19 and the internal keyway may stop rotation of the common axle 23 relative to the mandrel 19. In an embodiment, MDHF 1 has the grease ports for wheel lubrication and end slots for location of anti-rotation washers with axle end bolts.

FIG. 6(*b*) shows a reverse exploded isometric view of an embodiment of the front steering wheel assembly 2 to illustrate the locking bolt female thread 22 in the mandrel 19 and the associated bolt clearance hole 33 in the lower end of the ported housing 3. The locking bolt female thread 22 and the bolt clearance hole 33 ensure that the mandrel 19 and ported housing 3 remain locked together during operations.

FIG. 6(*c*) shows a magnified perspective of an embodiment of one side of the common axle 23 fitted in the mandrel 19 with exterior circlip 25, radial grease ports 24, and opposing anti-rotation washer cutaways 26. The anti-rotation washers 27 may eliminate the transfer of rotational forces from the wheels 29 and 30 to the axle end bolts 28 (as shown in FIG. 6(*a*)), ensuring that the axle end bolts 28 remain tight during operation.

Figure 7A:
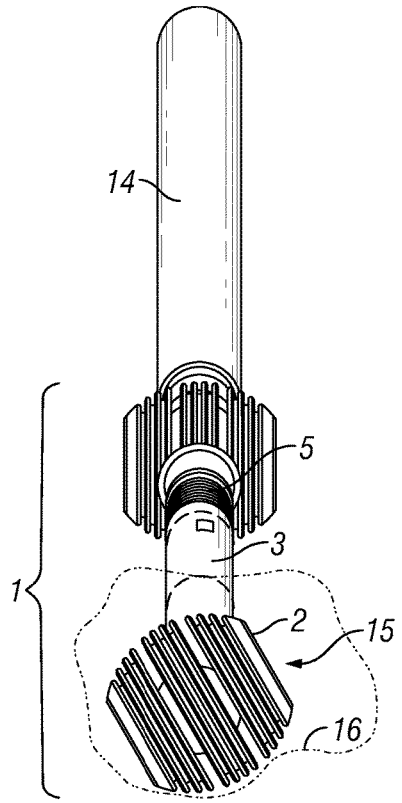
FIG. 7(*a*) illustrates an elevated view of an embodiment of the front steering wheel during rolling action in a rugose borehole.
Figure 7B:
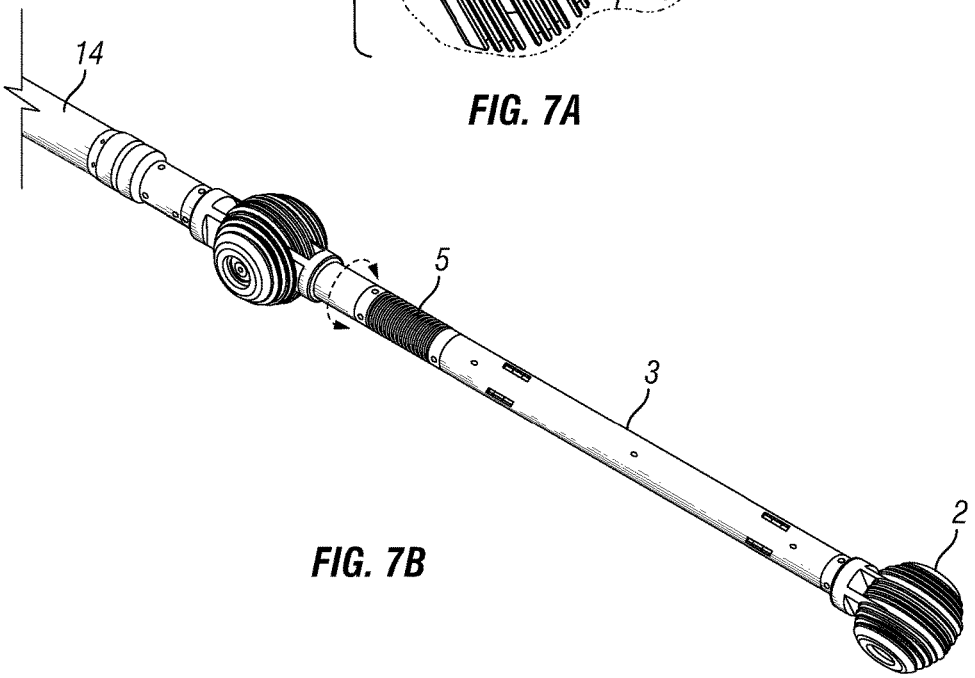

FIG. 7(*a*) is an end on view perspective of an embodiment of MSHF 1 with the front steering wheel 2 demonstrating a rolling action. In embodiments, when the front steering wheel assembly 2 rides over an irregular cross section of deviated sections 16, it may roll about the plane of the tapered spring joint 5.

FIG. 7(*b*) is an isometric view of an embodiment of the MSHF 1 with the front steering wheel assembly 2 demonstrating a rolling action. In embodiments, the front steering wheel assembly 2 and the ported housing 3 are locked together; because they are locked, they both roll about the axis of the main pin in tapered spring joint 5 as demonstrated by the arrow indicating the roll.

Figure 8:
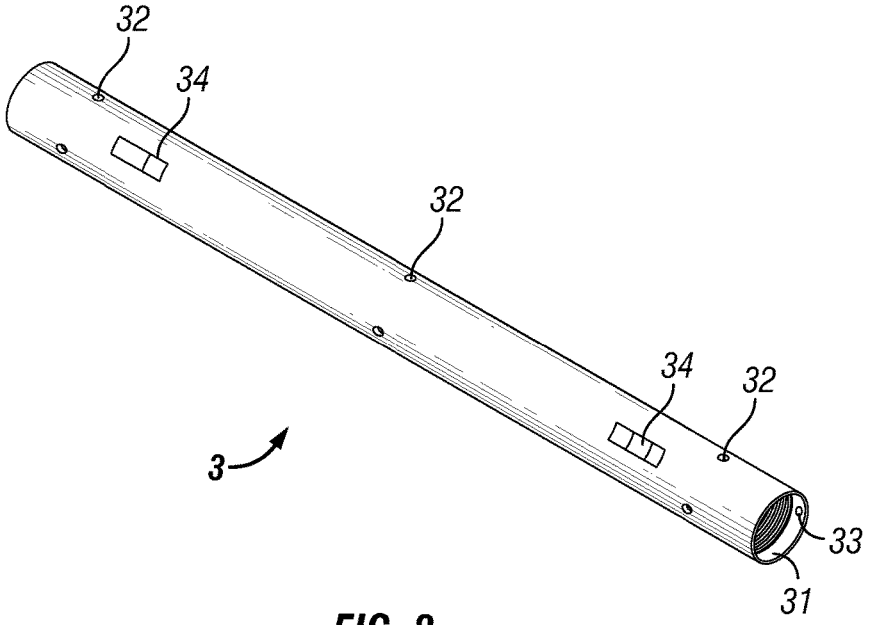
FIG. 8 illustrates an isometric view of an embodiment of the ported housing.

FIG. 8 is an isometric view of an embodiment of the ported housing 3. At either end of the ported housing 3, there are female stub acme threads 31 that may connect to the front steering wheel mandrel 19 (shown in FIG. 6(*a*)) and the tapered spring joint 5. Locking bolt clearance holes 33 lock with the locking bolt female thread 22 (shown in FIG. 6(*b*)). Additionally, embodiments may comprise radial mud equalization ports 32 phased at about ninety degrees in the ported housing 3. Radial mud equalization ports 32 may be phased at less than or more than ninety degrees. In this specific embodiment, twelve radial mud equalization ports 32 are used. Alternative embodiments may use more of less radial mud equalization ports 32. Embodiments may comprise angled flow ports 34 phased at about ninety degrees to facilitate bi-directional mud flow through the ported housing 3 when moving up or down the borehole. Angled flow ports 34 may be phased at less than or more than ninety degrees. In this specific embodiment, eight angled flow ports 34 are used. Alternative embodiments may use more of less angled flow ports 34.

Figure 9A:
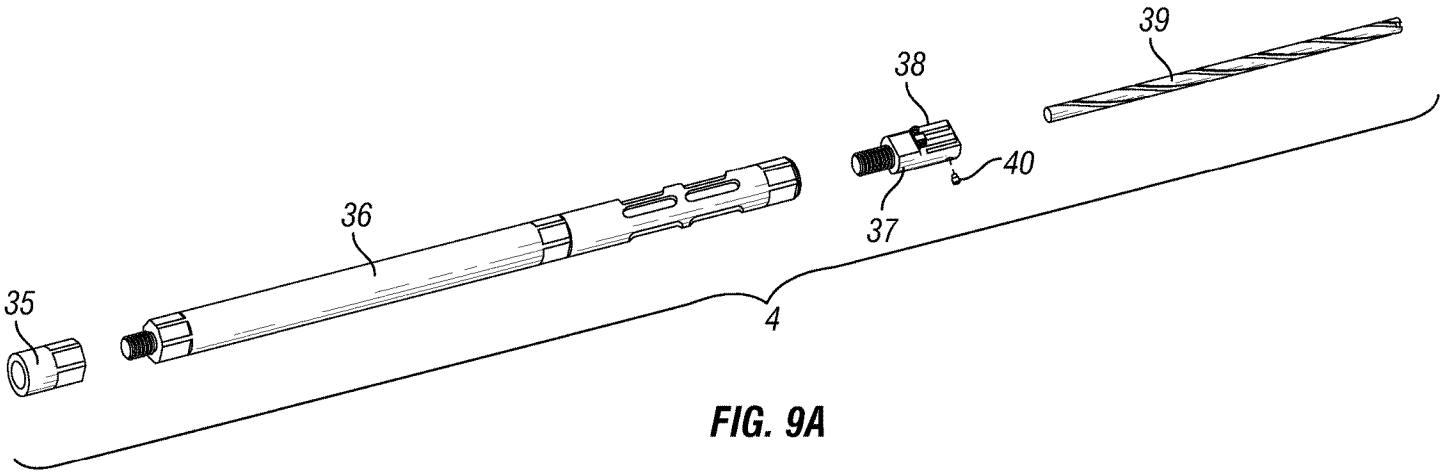
FIG. 9(*a*) illustrates an exploded isometric view of an embodiment of a sensor and corrosion package.
Figure 9B:
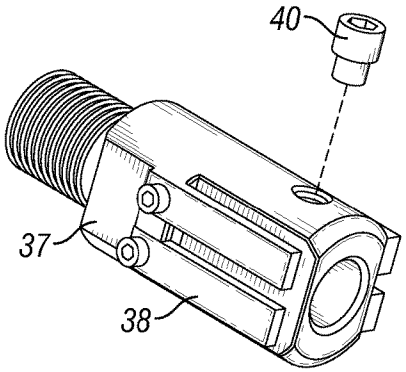

FIG. 9(*a*) is an exploded isometric view of an embodiment of a minimal sensor and corrosion package 4. This specific embodiment comprises a memory logging tool 36 which may record borehole pressure and temperature, and which may be used to calculate estimates of mud density as a function of borehole depth. In embodiments, the memory logging tool 36 connects to the main pin (not shown) in tapered spring joint 5 (see FIG. 1) via threaded crossover 35. Additionally, embodiments of the MSHF 1 may comprise a coupon carrier 37 for metallic corrosion coupons 38 and a test sample of logging cable 39. In this specific embodiment, the sensor and corrosion package 4 is approximately one meter long and has a maximum outer diameter of about one and three quarters inches. Alternative embodiments of the sensing and corrosion package may be of lengths greater than or less than one meter and may have diameters greater than or less than one and three quarters inches.

FIG. 9(*b*) is an isometric view of an embodiment of the coupon carrier 37 for metallic corrosion coupons 38. The coupon carrier 37 connects to the lower end of the memory logging tool 36 by means of a UNF thread. In embodiments, up to four corrosion coupons 38 may be attached to the coupon carrier 37. In alternative embodiments, more than or less than four corrosion coupons 38 may be attached. Corrosion coupons 38 may vary in sensitivity; for example in this embodiment there are two corrosion coupons 38 of high sensitivity and two of medium sensitivity. The test sample of logging cable 39 is disposed inside the coupon carrier 37 and then clamped in place with a grub screw 40. Once the logging cable 39 is returned to the surface, the logging cable 39 may be removed and evaluated for any signs of exposure to $H_2S$, namely the reduction of ductility.

Figure 10A:
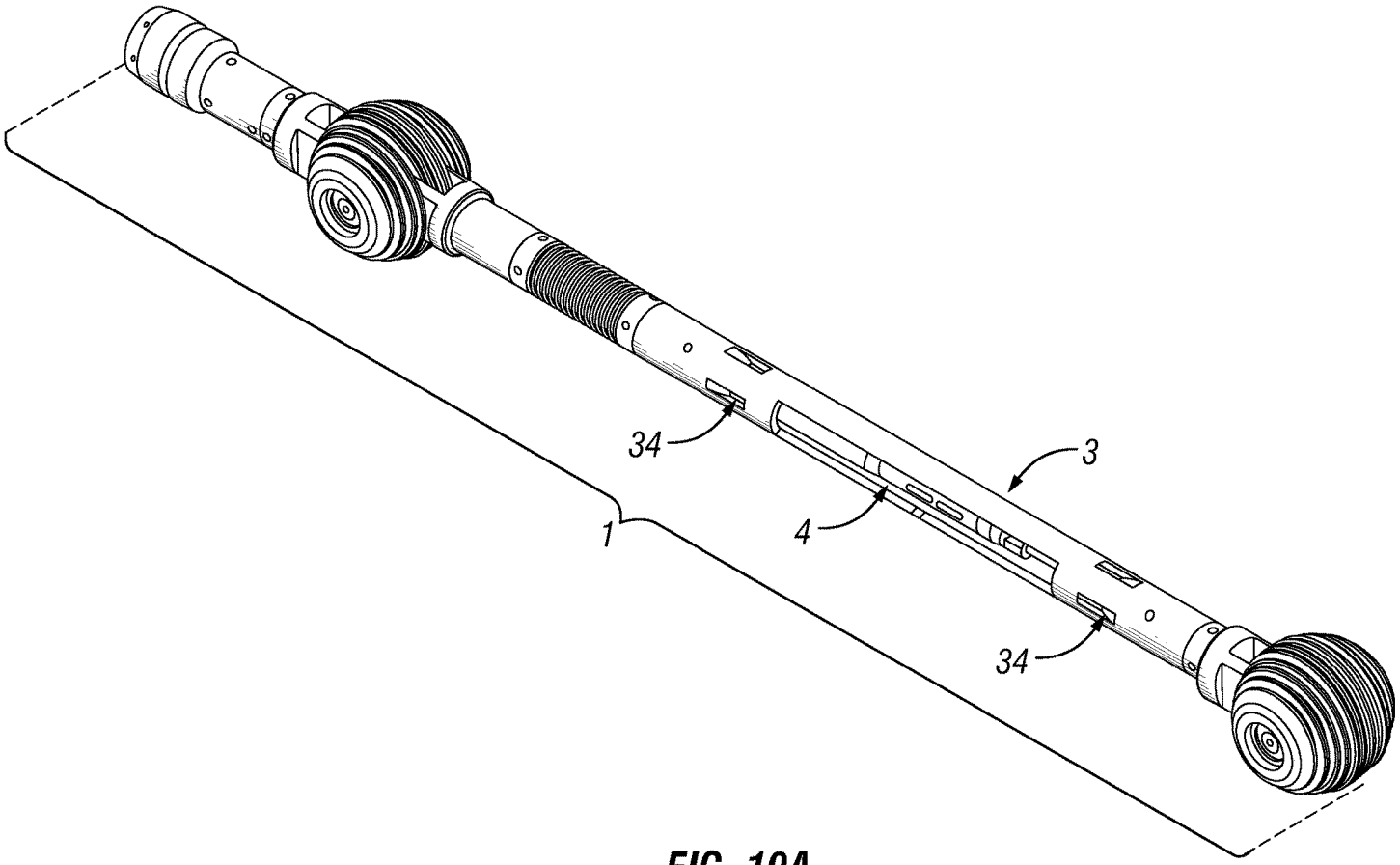
FIG. 10(*a*) illustrates an isometric view of an embodiment of the mud sensing hole finder with a cutaway to illustrate the location of the sensor and corrosion package in-situ, relative to the angled flow ports in the housing.
Figure 10B:
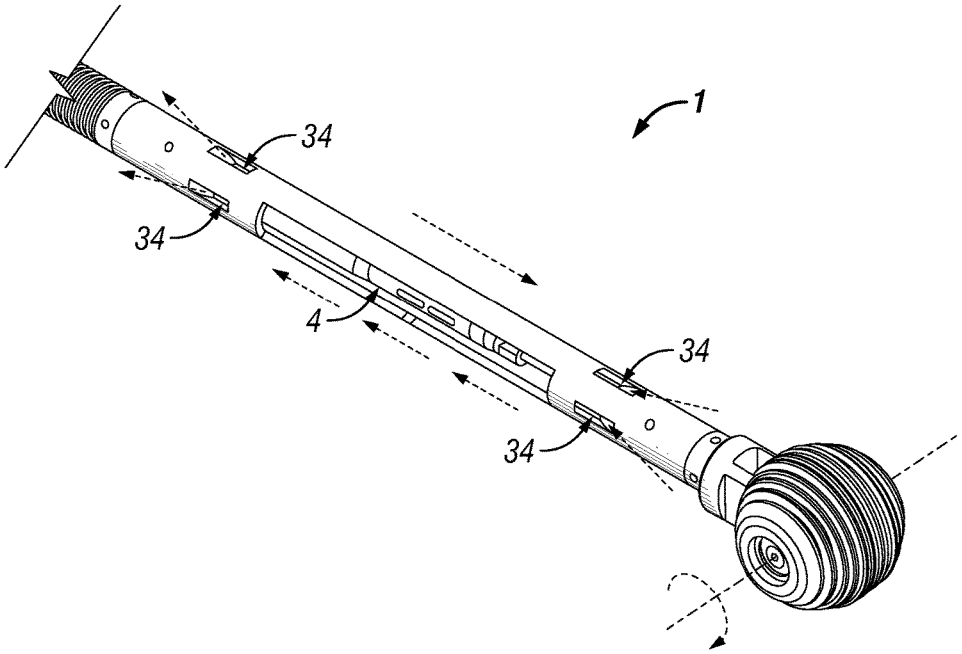
Figure 10C:
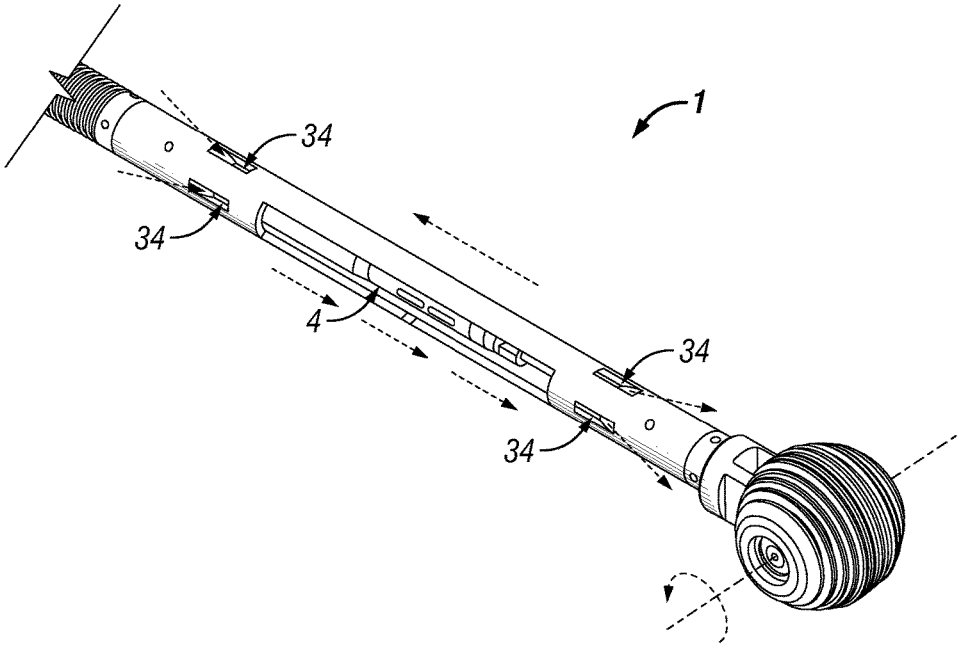

FIG. 10(*a*) is an isometric view of an embodiment of the MSHF 1 with a cutaway in the ported housing 3 to illustrate the in-situ location of the sensor and corrosion package 4 relative to the angled flow ports 34, which may be machined into the ported housing 3. The cutaway is purely for illustration purposes.

FIG. 10(*b*) is an isometric view of an embodiment of the MSHF 1 travelling down into a borehole 15, depicted by the opaque arrows illustrating the travel direction and roll. Also illustrated is the mud flow, depicted via the clear arrows. As shown by the clear arrows, in embodiments, the mud may flow through the lower or front angled flow ports 34 passed the sensor and corrosion package 4 and exit from the upper or back angled ports 34 while the MSHF 1 is travelling down the borehole 15.

FIG. 10(*c*) is an isometric view of an embodiment of the MSHF 1 travelling up and out of a borehole 15, depicted by the opaque arrows illustrating the travel direction and roll. Also illustrated is the mud flow, depicted via the clear arrows. As shown by the clear arrows, in embodiments, the mud may flow down through the upper or back angled ports 34 passed the sensor and corrosion package 4 and exit at the lower or front angled ports 34 while the MSHF 1 is travelling up through the borehole 15.

Figure 11A:
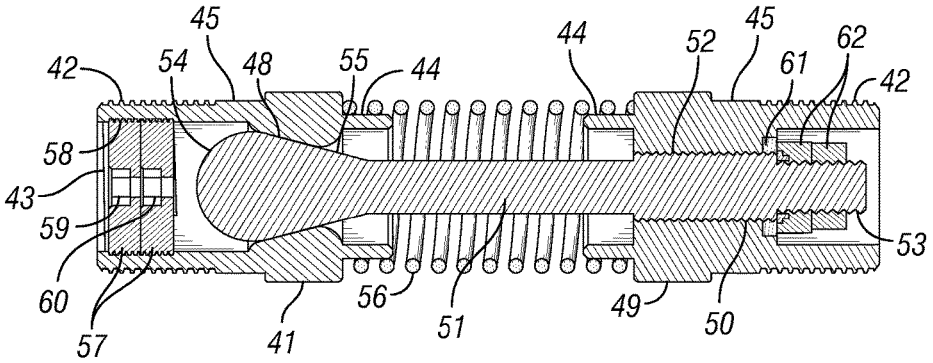
FIG. 11(*a*) illustrates a section view of an embodiment of the tapered spring joint showing internal components.
Figure 11B:
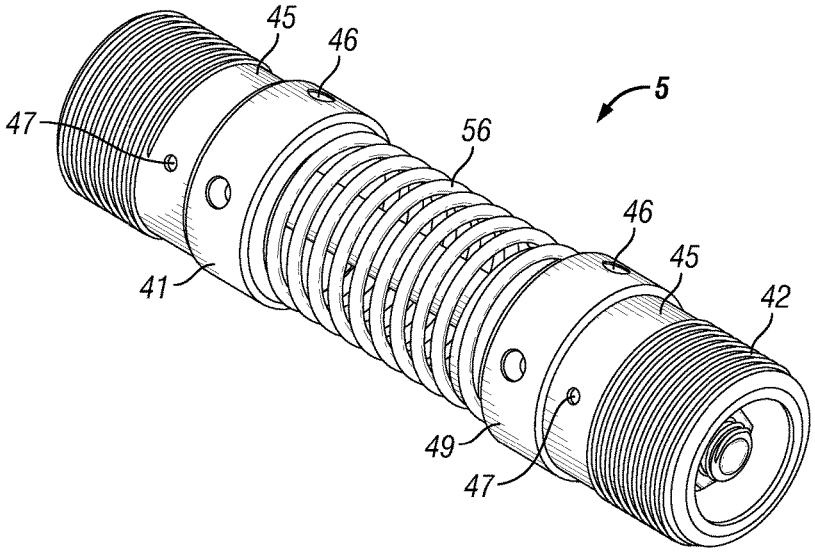
Figure 11C:
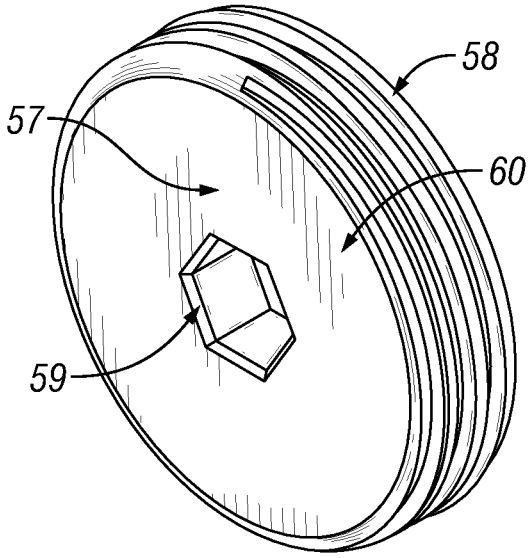

FIG. 11(*a*) illustrates a sectional view of an embodiment of the tapered spring joint 5. In embodiments, tapered spring joint 5 may comprise main pin 51, which is connected to the lower tapered spring joint halve 49 of tapered spring joint 5 via an internal male 52 and female 50 stub acme thread. In embodiments, the main pin 51 is locked into the lower half 47 of the tapered spring joint 5 with a washer 61 and two M20 nuts 62, which screw onto a male M20 thread 53 on the lower end of the main pin 51. In some embodiments, the upper end of the main pin 51 may not be permanently fixed in the upper tapered spring joint halve 41 of the tapered spring joint 5; it possesses a tapered ball joint 55 which positively locates in a female tapered flange 48, held in its default locked position by spring 56. Spring 56 pushes the two tapered spring joint halves 41 and 49 apart, thereby pulling the tapered ball joint 55 into the female tapered flange 48. Upon compression of the spring 56, the main pin 51 unseats itself from the female tapered flange 48 and allows articulation of up to twelve degrees from the central axis of the tapered spring joint 5. The upper end of the main pin 54 is hemispherical, and its axial motion is limited by the twin blanking plugs 57 which are positively located in the upper half of the tapered spring joint halve 41 via a stub acme thread 58. In embodiments, when the tapered spring joint 5 is actuated or locked straight, the spring 56 is held in alignment with the upper and lower tapered spring joint halves 41 and 49 respectively, by external spring flanges 44. When the spring compression is relieved, the tapered ball joint 55 pushes back into the female tapered flange 48, and the tapered spring joint 5 is locked in its default straight condition.

FIG. 11(*b*) illustrates an isometric view of an embodiment of the tapered spring joint 5. In embodiments, the external stub acme threads 42 connect the tapered spring joint 5 to the rear wheel assembly 6 and the upper end of the ported housing 3. The radial holes 46 for C-spanner usage are illustrated as are the female threads 47 for locking bolts to stop the tapered spring joint 5 connections from unscrewing during operations.

FIG. 11(*c*) illustrates an isometric view of an embodiment of the spring joint blanking plug 57 with exterior stub acme thread 58. The Allen key hole 59 may be used to tighten the spring joint blanking plug 57 into the upper half of the tapered spring joint halve 41. Through the center of the spring joint blanking plug 57 is a fluid entry port 60 which may allow wellbore fluids to equalize inside the upper half of the tapered spring joint halve 41. Note that the reference arrow for fluid entry port 60 is directed at a hidden line in the sketch.

Figure 12A:
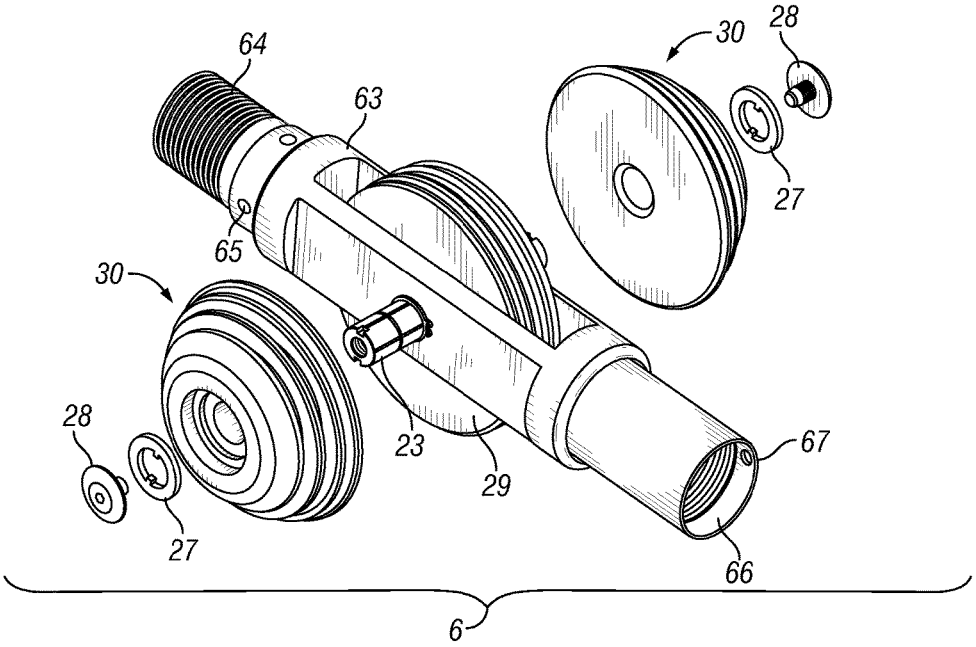
FIG. 12(*a*) illustrates an exploded isometric view of an embodiment of the rear wheel assembly.
Figure 12B:
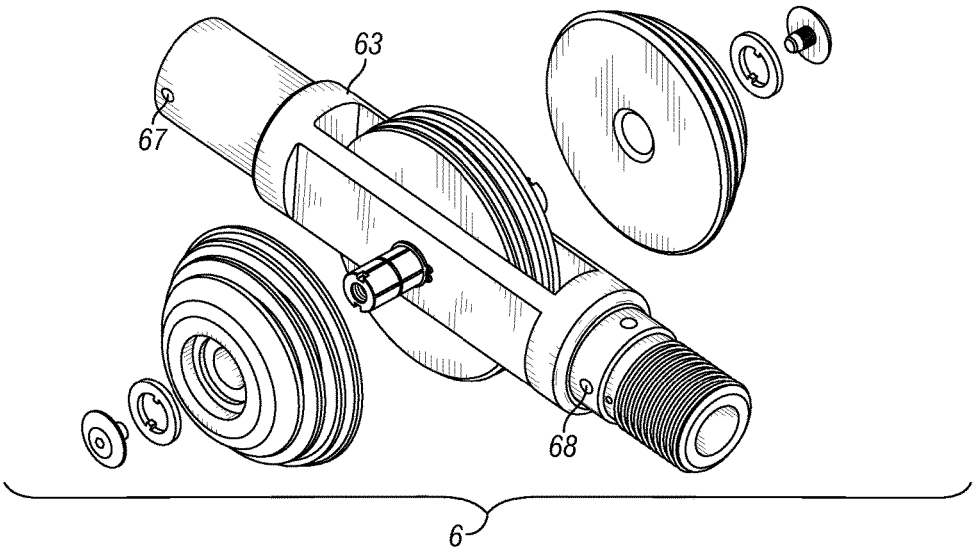

FIG. 12(*a*) illustrates an exploded isometric view of an embodiment of the rear wheel assembly 6. The mandrel 63 has an upper male stub acme thread 64 for connection to the wireline crossover 7. On the lower end of the mandrel 63 is a female stub acme thread 66 for connection to the upper end of the tapered spring joint 5. A series of radial holes 65 drilled into the mandrel body permit C-spanner usage during fitment to the wireline crossover 7. A deep slot in the mandrel 63 holds a common axle 23 for the mounting of the central wheel 29 and the outer wheels 30. The common axle 23 has internal threads on both ends for fitment of axle end bolts 28 and also anti-rotation washers 27, which isolate rotational forces from the outer wheels 30 that may otherwise act to undo the axle end bolts 28. The common axle 23 has radial and axial grease ports for wheel lubrication and is located positively in the mandrel by exterior circlips and an internal keyway (not shown). The circlips stop sideways slippage of the common axle 23 in the mandrel 19 and the keyway stops relative rotation of the common axle 23 to the mandrel 19.

FIG. 12(*b*) shows a reverse exploded isometric view of an embodiment of the rear wheel assembly 2 to illustrate the locking bolt female thread 68 in the mandrel 63 and the associated bolt clearance hole 67 which ensures the mandrel 63 and tapered spring joint 5 remain locked together during operations.

Figure 13:
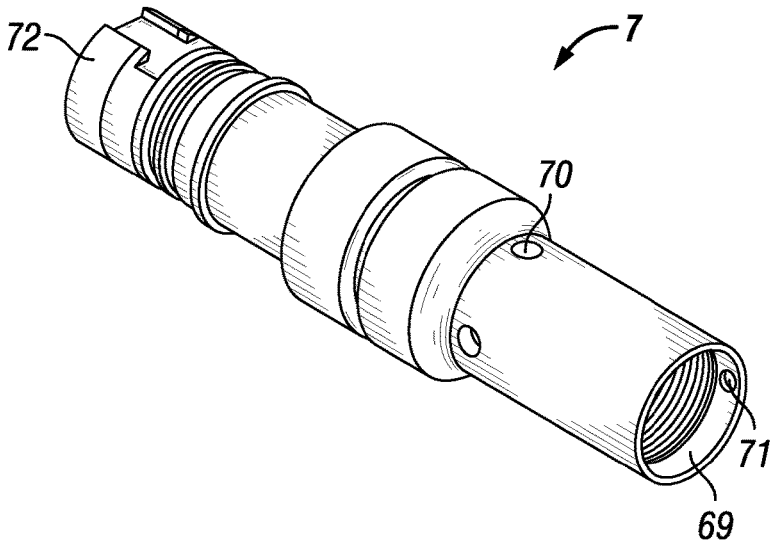
FIG. 13 illustrates an isometric view of an embodiment of the logging tool crossover.

FIG. 13 shows an isometric view of an embodiment of the wireline crossover 7 which fits between the upper end of the rear wheel assembly 6 by stub acme thread 69 and the wireline logging tool-string 14. The pressure sealed wireline logging tool-string connection 72 is shown on the upper end of the crossover 7 and may vary in design according to the logging vendor's specifications. Four opposing holes 70 for 'C' spanner usage also allow pressure equalization with the upper end of the spring joint 5. The clearance hole for the crossover locking bolt 71 stops the assembly from unscrewing during operations. In an embodiment, the pressure sealed crossover is to a logging vendor's wireline tool-string connection. In embodiments, MDHF 1 has pressure equalization and angled flow ports. In some embodiments, the pressure equalization and angled flow ports are capable of diverting borehole fluids through ported housing 3 and passed sensor and corrosion package 4.

In some embodiments, MDHF 1 has a single spring which has a rating selected according to weight of the wireline logging tool-string 14 above the mud sensing hole finder and maximum borehole deviation. In embodiments, MDHF 1 has a body with a single spring with an external diameter less than an external diameter of the body of MDHF 1.

It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present invention. If there is any conflict in the usages of a word or term in this specification and one or more patent(s) or other documents that may be incorporated herein by reference, the definitions that are consistent with this specification should be adopted.

What is claimed is:

1. A method comprising:

running a mud sensing hole finder into a borehole, wherein the mud sensing hole finder is capable of attachment to a wireline logging tool-string, wherein the mud sensing hole finder comprises:
- a front steering wheel assembly,
- a rear wheel assembly,
- a sensor package,
- a corrosion package,
- a tapered spring joint, and
- a ported housing;

diverting, with the ported housing, mud flow passed the sensor package and the corrosion package while the mud sensing hole finder is moving in a borehole;

pulling the mud sensing hole finder from the borehole; and reversing a direction of the mud flow through the ported housing.

2. The method of claim 1, wherein the tapered spring joint is pivotable to facilitate lateral movement of the front steering wheel assembly passed obstructions in a borehole.

3. The method of claim 1, wherein the mud sensing hole finder further comprises a pressure sealed crossover to a logging vendor's wireline tool-string connection.

4. The method of claim 1, wherein the mud sensing hole finder further comprises a mandrel that holds a common axle and a set of profiled and grooved wheels.

5. The method of claim 1, further comprising acquiring data with a logging package for borehole diagnostics and wireline conveyance optimization.

6. The method of claim 1, further comprising providing corrosion analysis, mechanical testing, archiving, or any combinations thereof.

7. The method of claim 1, wherein the mud sensing hole finder further comprises threaded connections to the front steering wheel assembly and the tapered spring joint.

8. A method comprising:

running a mud sensing hole finder into a borehole, wherein the mud sensing hole finder is capable of attachment to a wireline logging tool-string, wherein the mud sensing hole finder comprises:

a front steering wheel assembly, a rear wheel assembly, a sensor package, a corrosion package, a ported housing, and a tapered spring joint;

wherein the ported housing comprises threaded connections to the front steering wheel assembly and the tapered spring joint and also to pressure equalization ports and angled flow ports;

wherein the front steering wheel assembly comprises a mandrel that holds a common axle and a set of profiled and grooved wheels;

wherein the rear wheel assembly comprises a mandrel that holds a common axle and a set of profiled and grooved wheels;

wherein the sensor package comprises a surface acquisition module that performs time-depth conversions of acquired data;

wherein the corrosion package comprises a carrier holding multiple metallic test coupons;

wherein the tapered spring joint comprises two halves, a main pin, and a spring, and wherein the main pin connects the two halves and wherein the spring is under compression;

pulling the mud sensing hole finder from the borehole; and reversing a direction of mud flow through the ported housing.

* * * * *